United States Patent [19]

Stellato et al.

[11] Patent Number: 4,588,165

[45] Date of Patent: May 13, 1986

[54] ENGINE STAND AND CRANE

[76] Inventors: Antonio J. Stellato; George Spector, both of 233 Broadway; Rm 3615, New York, N.Y. 10007

[21] Appl. No.: 684,373

[22] Filed: Dec. 20, 1984

[51] Int. Cl.[4] ..... B66F 3/00

[52] U.S. Cl. ..... 254/8 B; 254/124

[58] Field of Search ..... 254/8 R, 8 B, 133, 89 R, 254/134, 89 H, 124; 269/17

[56] References Cited

U.S. PATENT DOCUMENTS

| | | | |
|---|---|---|---|
| 2,903,258 | 9/1959 | Jovanovich | 254/134 |
| 3,059,785 | 10/1962 | Buckeye | 254/8 R |
| 3,381,953 | 5/1968 | Miller | 269/17 |
| 3,834,669 | 9/1974 | Reid | 254/133 |
| 4,190,233 | 2/1980 | Godfrey | 254/8 B |
| 4,462,569 | 7/1984 | Arzouman | 254/8 B |
| 4,479,634 | 10/1984 | Blatz | 254/133 R |

*Primary Examiner*—Robert C. Watson

[57] ABSTRACT

A combination engine stand and engine puller crane is provided wherein the base frame of the engine puller crane removably interlocks with the base frame of the engine stand allowing one person to remove an engine from a motor vehicle by the use of the engine puller crane and then secure the engine to the engine stand.

1 Claim, 4 Drawing Figures

ENGINE STAND AND CRANE

BACKGROUND OF THE INVENTION

The instant invention relates generally to engine stands and more specifically it relates to a combination engine stand and engine puller crane.

Numerous engine stands have been provided in prior art that are adapted to hold motor vehicle engines for repair jobs. While these prior art units may be suitable for the particular purpose to which they address, they would not be suitable for the purposes of the present invention as heretofore described.

SUMMARY OF THE INVENTION

A principle object of the present invention is to provide a combination engine stand and engine puller crane that will enable one person to remove an engine from any motor vehicle by the engine puller crane and mount it to the engine stand; then unhooking the engine puller crane from the engine stand to move the engine stand to any location to work on the engine.

Another object is to provide a combination engine stand and engine puller crane that allows one man to completely strip and rebuild an engine mounted to the engine stand by revolving the engine in several positions and turning it 360 degrees without any strain whatsoever.

An additional object is to provide a combination engine stand and engine puller crane that allows separation of the engine puller crane from the engine stand only when the engine mounted to the engine stand is in its proper position.

A further object is to provide a combination engine stand and engine puller crane that is simple and easy to use.

A still further object is to provide a combination engine stand and engine puller crane that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
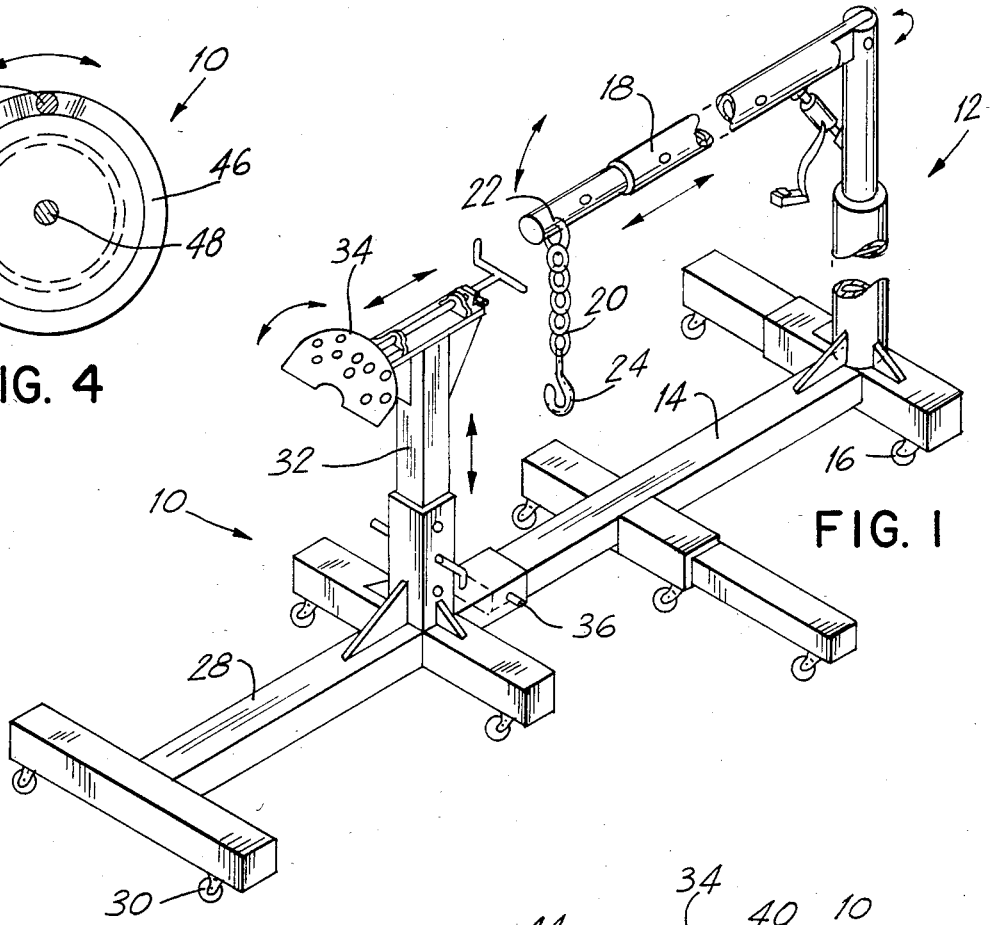
FIG. 1 is a perspective view of the invention with parts broken away.
Figure 2:
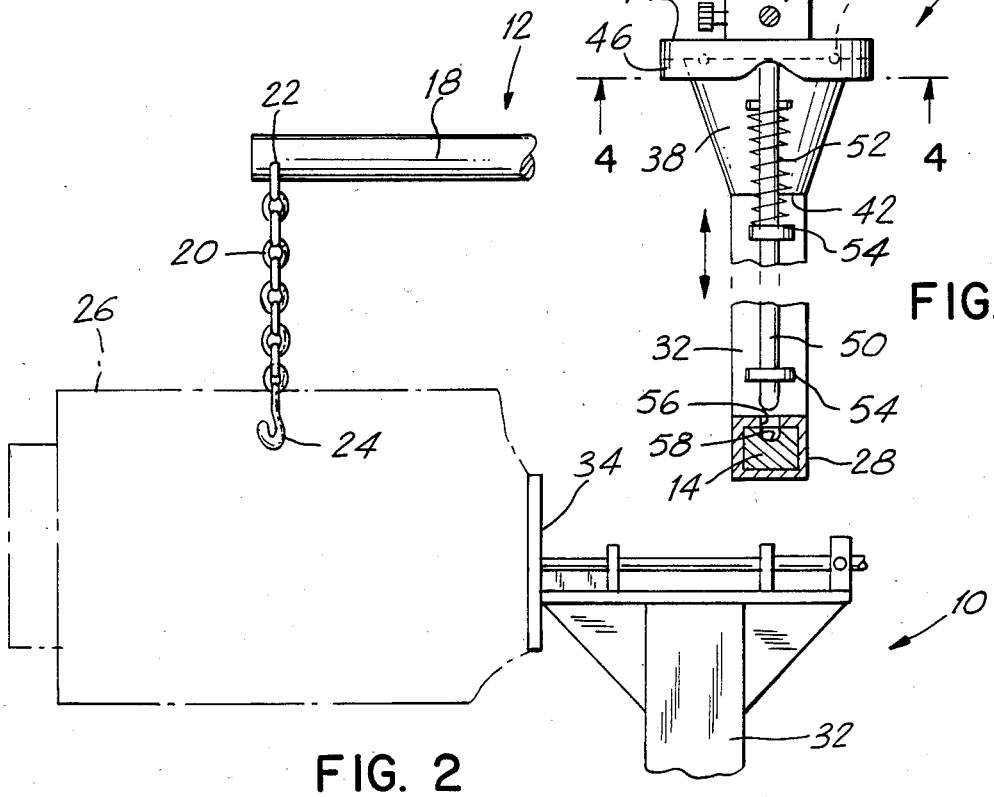
FIG. 2 is a partial side view showing the engine puller crane placing an engine in phantom adjacent the swivel plate engine mounting head of the engine stand.

Turning now descriptively to the drawings, in which similar reference characters denote similar elements throughout the several views, FIGS. 1 and 2 illustrates a combination engine stand 10 and engine puller crane 12. The engine puller crane has an H-shaped base frame 14 and a plurality of casters 16 mounted to underside of the base frame 14 making the base frame mobile. The base frame 14 can roll easily along a flat surface.

An inverted L-shaped adjustable boom assembly 18 is mounted to one side of the base frame 14. A hoist chain 20 is affixed to free end 22 of the boom assembly 18. The hoist chain 20 has a crane hook 24 at free end to hoist an engine 26 (shown in phantom) from a motor vehicle (not shown).

The engine stand 10 has an H-shaped base frame 28 and a plurality of casters 30 mounted to underside of the base frame 28 making the base frame mobile. The base frame 28 can roll easily along a flat surface.

An adjustable vertical support bar 32 is mounted to one side of the base frame 28. A swivel plate engine mounting head 34 is horizontally rotatably affixed to the support bar 32 to secure the engine 26 that is supported by the crane hook 24 of the engine puller crane 12.

The base frame 14 of the engine puller crane 12 removably interlocks at 36 with the base frame 28 of the engine stand 10. This allows one person to remove the engine 26 from the motor vehicle using the engine puller crane 12 and securing the engine 26 to the engine stand 10.

Figure 4:
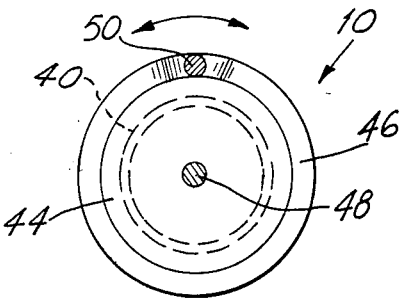
FIG. 4 is a cross sectional view taken along line 4—4 in FIG. 3.
Figure 3:
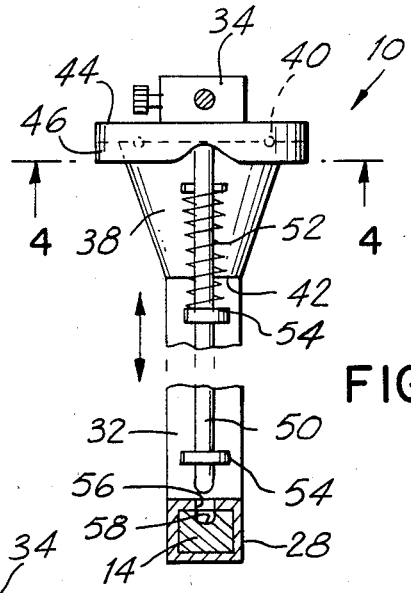
FIG. 3 is a rear view partly in section with parts broken away of a modification of the engine stand showing the swivel plate engine mounting head being rotatable around a vertical axis and operating a locking bar to the engine puller crane.

FIGS. 3 and 4 show a modification in the engine stand 10. The adjustable vertical support bar 32 has an inverted cone shaped portion 38 with a circular bearing race 40, mounted at top end 42 thereof.

The swivel plate engine mounting head 34 has a circular platform 44 with an integral annular cam 46 formed on underside. A shaft 48 is mounted to center underside of the circular platform 44 so that the circular platform can rotate around a vertical axis on the circular bearing race 40.

A vertical locking bar 50 is provided. It is spring biased upwardly at 52 and is slideably mounted at 54 to the vertical support bar 32. The locking bar 50 is in engagement with the cam 46 so that when the platform 44 rotates out of proper alignment the cam 46 will push the locking bar 50 downward into the base frame 28 that has an aperture 56 of the engine stand 10 and the base frame 14 that has an aperture 58 of the engine puller crane 12 preventing removal therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination engine stand and engine puller crane wherein said engine puller crane comprises:

(a) an H-shaped base frame;

(b) a plurality of casters mounted to underside of said base frame making said base frame mobile so that said base frame can roll easily along a flat surface;

(c) an inverted L-shaped adjustable boom assembly mounted to one side of said base frame; and (d) a hoist chain having a crane hook at one end, said hoist chain affixed to the free end of said boom assembly whereby said crane hook can hoist an engine from a motor vehicle, wherein said engine stand comprises:

(a) an adjustable vertical support bar mounted to one side of said base frame; and (b) a swivel plate engine mounting head horizontally rotatably affixed to said support bar to secure said engine that is supported by said crane hook of said engine puller crane, wherein said base frame of said engine puller frame removeably interlocks with said base frame of said engine stand allowing one person to remove said engine from said motor vehicle using said engine puller crane and securing said engine to said engine stand, wherein said engine further comprises:

(a) said adjustable vertical support bar having an inverted cone shaped portion with a circular bearing race, mounted at the top end thereof;

(b) said swivel plate engine mounting head having circular platform with an integral annular cam formed on the underside;

(c) a shaft mounted to the center underside of said circular platform so that said circular platform can rotate around a vertical axis on said circular bearing race; and (d) a vertical locking bar spring biased upward and slideably mounted to said vertical support bar, said locking bar in engagement with said cam so that when said platform rotates out of proper alignment said cam will push said locking bar downward into said base frame, having an aperture, of said engine stand and said base frame, having an aperture, of said engine puller crane preventing removal therefrom.

* * * * *